United States Patent [19]

Svekis

[11] 4,018,982

[45] Apr. 19, 1977

[54] HOUSING STRUCTURE FOR ELECTRICAL APPARATUS

[75] Inventor: Imants J. Svekis, Mississauga, Canada

[73] Assignee: The Canadian Chromalox Company, Limited, Rexdale, Canada

[22] Filed: Mar. 8, 1976

[21] Appl. No.: 664,586

[30] Foreign Application Priority Data

June 24, 1975 Canada ..... 230022

[52] U.S. Cl. ..... 174/65 R; 219/342; 219/366; 285/129

[51] Int. Cl.[2] ..... F24H 9/02

[58] Field of Search ..... 174/65 R; 220/3.92, 220/3.94; 285/128, 129; 219/342, 365, 366, 367, 368

[56] References Cited

UNITED STATES PATENTS

| | | | |
|---|---|---|---|
| 1,901,943 | 3/1933 | Adell | 285/128 X |
| 2,131,165 | 9/1938 | Clements | 174/65 R |
| 3,084,958 | 4/1963 | Appleton | 174/65 R X |
| 3,410,582 | 11/1968 | Appleton | 174/65 R X |
| 3,500,017 | 3/1970 | Zahaykevich | 174/65 R X |
| 3,600,008 | 8/1971 | Barry | 174/65 R X |

*Primary Examiner*—J. V. Truhe
*Assistant Examiner*—D. A. Tone

[57] ABSTRACT

An electric heater adapted to be mounted against a flat wall surface has a box-like housing of sheet metal, the housing being partitioned to provide a heating section and a terminal box section. The housing has a generally flat rear wall with an aperture positioned to provide manual access to the terminal box section, the aperture having peripheral flanges defining a recess adapted to receive and locate a cover plate. The cover plate is secured to the rear wall and accommodated with the recess. The cover plate is formed with a groove for locating a power cable clamped to it by means of a clamping plate, and includes an indented portion formed with an opening aligned with the groove to receive the power cable which extends into the terminal box section.

11 Claims, 4 Drawing Figures

FIG. 1
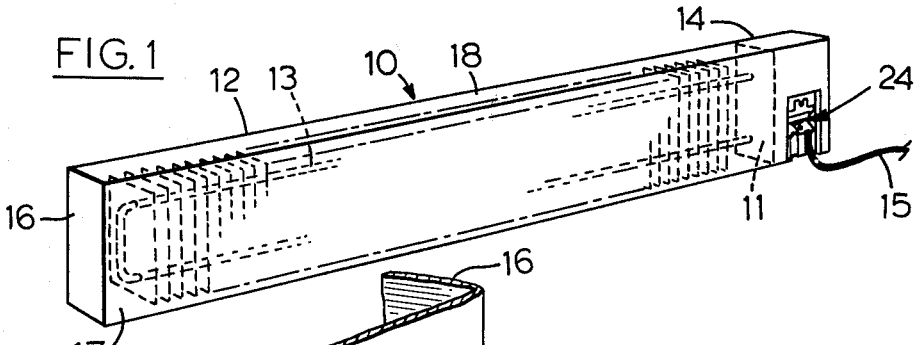
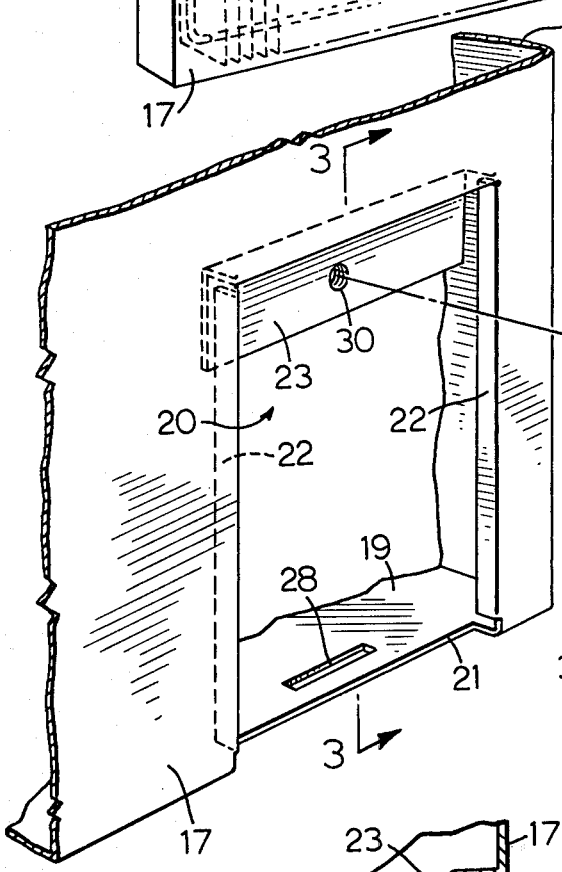
FIG. 2
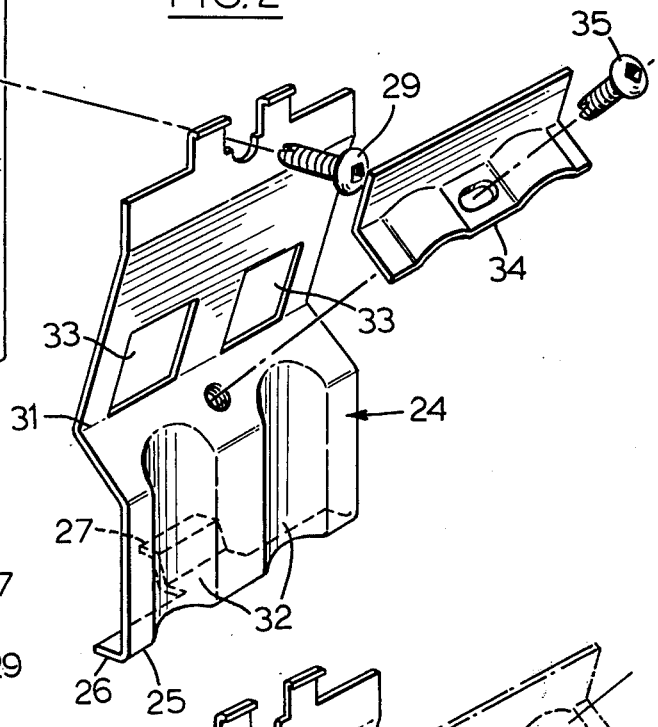
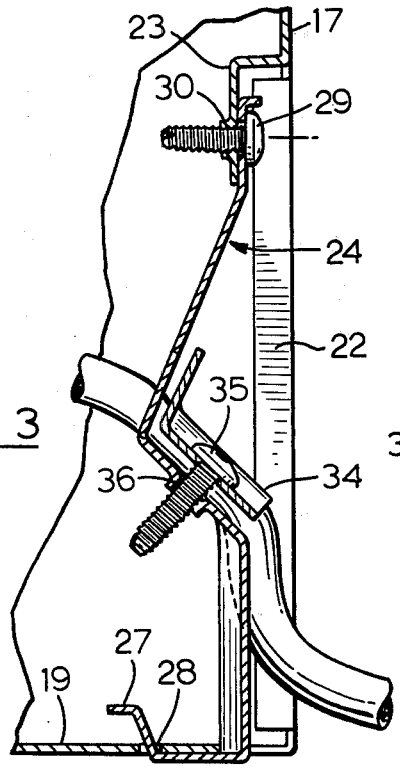
FIG. 3
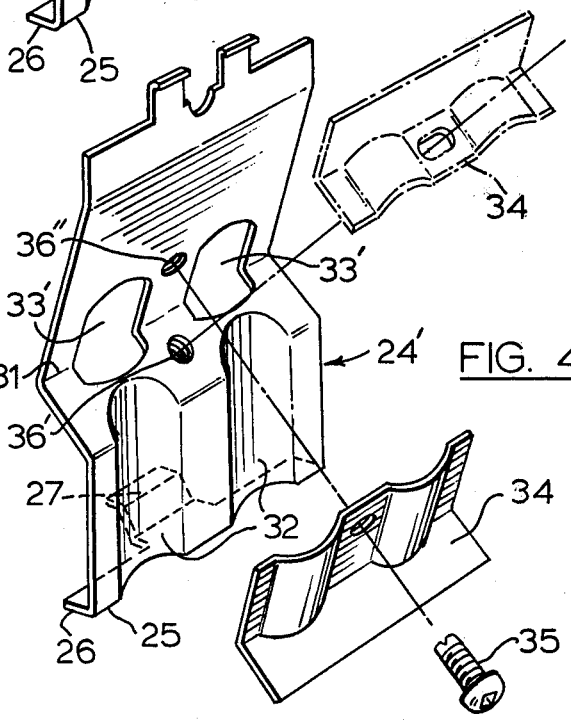
FIG. 4

HOUSING STRUCTURE FOR ELECTRICAL APPARATUS

This invention relates to a housing structure for an electrical apparatus, in which during installation a power cable passing through an opening in the rear wall of the housing must be connected to a terminal section of the apparatus.

It is an object of the invention to provide such a housing structure in which the problem of installation is simplified.

According to one aspect of the invention there is provided a box-like housing for an electrical apparatus, the housing providing a terminal box section and having a generally flat rear wall including an aperture positioned to provide manual access to the terminal box section, a removable cover plate for the aperture and means for securing the cover plate to the rear wall to cover the aperture, the cover plate including an opening to receive a pass-through cable, a clamping plate mounted on the cover plate, and means for securing the clamping plate to the cover plate to clamp the pass-through cable in a located position.

The invention is especially applicable to electric heaters, such as, for example, baseboard heaters. One such baseboard heater is described and illustrated in Canadian Pat. No. 849,656, dated Aug. 18, 1970 and granted to Federal Pacific Electric Company. The heater described therein has an elongated box-like housing which is partitioned to provide a heater section and a terminal box section, the housing including a generally flat rear wall formed with an aperture positioned to provide manual access to the terminal box section and closed by a removable cover plate. The cover plate is essentially free of projecting structure extending to the rear of the flat rear wall of the housing, and is provided with a removable knock-out that is removable for receiving and mounting a pass-through power cable connector, the cover plate being non-removable when the housing is mounted against a flat wall surface.

The present invention relates to a heater of this general type in which the rear cover plate, instead of being formed with a knock-out, is provided with clamping means for a power cable extending through a preformed opening in the cover plate. Thus, an electric heater according to the invention has a box-like housing which is partitioned to provide a heating section and a terminal box section, the housing having a generally flat rear wall including an aperture positioned to provide manual access to the terminal box section, a removable cover plate for the aperture and means for securing the cover plate to the rear wall to cover the aperture, the cover plate including an opening to receive a power cable, a clamping plate mounted on the cover plate, and means for securing the clamping plate to the cover plate to clamp the power cable in a located position. In a preferred embodiment of the invention, the aperture has peripheral flanges defining a recess adapted to receive and locate the cover plate, the cover plate being accommodated within the recess when secured to the rear wall, the cover plate being formed with a groove for locating the power cable and also having an indented portion including said opening, which is aligned with the groove.

In order that the invention may be readily understood, one embodiment thereof will now be described, by way of example, with reference to the accompanying drawing, in which:

FIG. 1 is a rear perspective view of the heater;

FIG. 2 is an exploded view showing the housing aperture and cover plate therefor;

FIG. 3 is a fragmentary sectional view of the cover plate when mounted; and

FIG. 4 is an exploded view showing a detail of a modification.

Referring to FIG. 1, an electric baseboard heater has an elongated, horizontally extending, boxlike housing 10 of sheet metal. A transverse partition 11 near one end of the housing defines a heater section 12, in which a heating element 13 is mounted, and a terminal box section 14. A power cable 15 for supplying power to the heater extends through an opening in the rear of the housing 10 as will shortly be described, and is terminated therein at terminals to which the heating element 13 is connected in the manner well known in the art.

The housing 10 has a pair of opposed end walls 16, a generally flat rear wall 17, a top wall 18, and a bottom wall 19. The rear wall 17 includes an aperture 20 which is positioned to provide manual access to the terminal box section 14, the aperture extending to the bottom edge of the rear wall. The rear edge of the bottom wall 19 has an indentation 21 which is coextensive with the aperture 20. The aperture 20 is formed with peripheral flanges including a pair of in-turned side flanges 22 and a locating flange 23 adjacent its upper edge; these flanges define with the intended edge 21 a recess for receiving and locating a cover plate 24. The depth of the recess is such that the cover plate is wholly accommodated within the recess when secured to the rear wall structure as shown in FIG. 3.

The cover plate 24, which is pressed out of sheet metal, has a lower edge 25 which merges with a horizontal bottom flange 26. The flange 26 extends beneath the rear edge of the bottom wall 19, and is formed with a forwardly and upwardly extending tongue 27 which engages in an appropriately positioned slot 28 in the bottom wall to locate the cover plate. The cover plate is secured to the rear wall structure to cover the aperture 20 by means of a clamping screw 29 which engages in a threaded hole 30. The arrangement is such that the clamping screw may be loosened, without being detached from the rear wall, so as to disengage the cover plate thereby permitting the latter to be pivoted downwards to an open position. The cover plate includes an indented portion 31 formed by a pair of adjacent, inwardly pressed plate portions. A pair of cable-locating grooves 32 extend from the indented portion 31 to the lower edge 25. A pair of openings 33 in the indented portion are aligned with the grooves 32, each opening being adapted to receive a pass-through cable such as 15.

In order to locate and secure the cable 15, the latter is located in a groove 32 and is clamped by means of a clamping plate 34. The clamping plate 34 is flanged so as to conform to the shape of the indented portion 31, and has a profiled cable-clamping portion adapted to cooperate with the grooves 32 to clamp power cables therein. The clamping plate is secured to the cover plate by means of a clamping screw 35 which engages a threaded hole 36 in the cover plate.

FIG. 4 shows a detail of a modified cover plate. The cover plate 24' differs from the cover plate shown in FIG. 2 in that the openings 33', instead of being rectangular have rounded ends. The cover plate is also formed with a pair of threaded holes 36' and 36'', each adapted to receive the clamping screw 35. As will be apparent from the configuration shown in FIG. 4, the clamping plate 34 may be inverted and clamped to either of the sloping portions of the cover plate, thereby to clamp a cable which is led in from below, as in FIG. 3, or alternatively to clamp the cable when it is led into the terminal box from a higher position.

What I claim as my invention is:

1. For an electrical apparatus, a box-like housing which provides a terminal box section, the housing having a generally flat rear wall including an aperture positioned to provide manual access to the terminal box section, a removable cover plate for the aperture and means for securing the cover plate to the rear wall to cover the aperture, the cover plate including an opening to receive a pass-through cable, a clamping plate mounted on the cover plate, and means for securing the clamping plate to the cover plate in position to clamp the cable against an outer surface of said cover plate adjacent said opening, said clamping plate also overlying and covering said opening.

2. A box-like housing according to claim 1, wherein said aperture has peripheral flanges defining a recess adapted to receive and locate the cover plate, the cover plate being accommodated within the recess when secured to the rear wall.

3. A box-like housing according to claim 2, wherein the cover plate is formed with a groove for locating the cable, the cover plate also being formed with an indented portion including said opening, which is aligned with the groove.

4. An electric heater housing having an elongated, horizontally extending, box-like housing which is partitioned to provide a heating section and a terminal box section, the housing comprising a pair of opposed end walls, top and bottom walls, and a generally flat rear wall, the rear wall including an aperture positioned to provide manual access to the terminal box section, a removable cover plate for the aperture and means for securing the cover plate to the rear wall to cover the aperture, the aperture having peripheral flanges defining with a rear edge of said bottom wall, a recess adapted to receive and locate the cover plate, the cover plate being accommodated within the recess when secured to the rear wall, the cover plate being formed with a groove for locating a power cable clamped to the cover plate, the cover plate further including an indented portion formed with an opening aligned with the groove to receive a power cable located therein, a clamping plate mounted on the cover plate, and means for securing the clamping plate to the cover plate to clamp the power cable in its located position.

5. An electric heater housing according to claim 4, wherein the box-like housing and cover plate are of sheet metal.

6. An electric heater housing according to claim 5, wherein the cover plate has a horizontal bottom flange which engages beneath the rear edge of the bottom wall when the cover plate is clamped in position.

7. An electric heater housing according to claim 6, wherein the cover plate is formed with a tongue extending forwardly and upwardly from said horizontal bottom flange, the bottom wall of the housing having a slot positioned to receive the tongue whereby to locate the cover plate.

8. An electric heater housing having an elongated, horizontally extending, box-like housing of sheet metal which is partitioned to provide a heating section and a terminal box section, the housing comprising a pair of opposed end walls, top and bottom walls, and a generally flat rear wall, the rear wall including an aperture positioned to provide manual access to the terminal box section and extending to a bottom edge of said rear wall. the bottom wall providing a rear edge having an indentation which is coextensive with the aperture, a removable cover plate for the aperture and means for securing the cover plate to the rear wall to cover the aperture, the aperture having peripheral flanges defining with the indentation of said rear edge, a recess adapted to receive and locate the cover plate, the cover plate being accommodated within the recess when secured to the rear wall, the cover plate being formed with a groove for locating a power cable clamped to the cover plate, the cover plate further including an indented portion formed with an opening aligned with the groove to receive a power cable located therein, a clamping plate mounted on the cover plate, and means for securing the clamping plate to the cover plate to clamp the power cable in its located position.

9. An electric heater housing according to claim 8, wherein the cover plate has a lower edge merging with a horizontal bottom flange which engages beneath said rear edge of the bottom wall when the cover plate is secured in position, said groove extending from the indented portion of the cover plate to said lower edge.

10. An electric heater housing according to claim 9, wherein the cover plate is formed with a tongue extending forwardly and upwardly from said horizontal bottom flange, the bottom wall of the housing having a slot position to receive the tongue for locating the cover plate.

11. An electric heater housing according to claim 10, wherein the cover plate is formed with a pair of said grooves extending from the indented portion of the cover plate to its lower edge.

* * * * *